United States Patent [19]

Geldwerth

[11] Patent Number: 4,697,315

[45] Date of Patent: Oct. 6, 1987

[54] REINFORCED JEWELRY CLASP

[75] Inventor: Simon Geldwerth, Brooklyn, N.Y.

[73] Assignee: Do-All Jewelry Mfg. Co., Inc., Springfield, N.J.

[21] Appl. No.: 688,324

[22] Filed: Jan. 2, 1985

[51] Int. Cl.[4] ..... A44B 11/25

[52] U.S. Cl. ..... 24/616; 24/693; 29/160.6; 228/173.6

[58] Field of Search ..... 24/614–616, 24/625, 265 R, 265 AL, 693; 403/232.1, 231, 272; 411/338; 228/173.6; 29/10, 160.6

[56] References Cited

U.S. PATENT DOCUMENTS

| | | | |
|---|---|---|---|
| 875,755 | 1/1908 | Wanner | 403/231 |
| 1,346,736 | 7/1920 | Allee | 403/231 X |
| 2,952,058 | 9/1960 | Geldwerth | 24/616 |
| 3,269,145 | 8/1966 | Druskin | 24/616 |
| 3,458,224 | 7/1969 | Freese | 403/272 X |
| 3,951,559 | 4/1976 | Casey | 228/173.6 X |
| 3,967,353 | 7/1976 | Pagnotta et al. | 403/272 X |
| 4,068,964 | 1/1978 | Stoker | 403/272 |
| 4,170,809 | 10/1979 | Geldwerth et al. . | |
| 4,246,680 | 1/1981 | Gray | 24/616 X |
| 4,480,869 | 11/1984 | Splithoff | 411/338 X |

FOREIGN PATENT DOCUMENTS

| | | | |
|---|---|---|---|
| 622855 | 11/1935 | Fed. Rep. of Germany | 403/272 |
| 52138 | 8/1943 | France | 403/272 |
| 2451175 | 11/1980 | France | 24/616 |
| 64748 | 1/1913 | Switzerland | 24/616 |
| 75 | of 1908 | United Kingdom | 24/616 |

*Primary Examiner*—Kenneth J. Dorner
*Assistant Examiner*—James R. Brittain
*Attorney, Agent, or Firm*—Sandler & Greenblum

[57] ABSTRACT

A jewelry clasp comprising an angled portion which is subject to stress as a result of the weight of the jewelry to which it is attached, is provided with at least one reinforcement rib positioned and configured to increase the tensile strength of the angled portion.

A method of forming a jewelry clasp having at least one reinforcement rib, and attachement means thereon for attachment of the jewelry to the clasp. The attachment means is secured to the jewelry by soldering such that the solder flows into the corresponding groove formed on the outside of the angled portion thereby anchoring the solder connection, and strengthening the at least one reinforcement rib itself.

14 Claims, 9 Drawing Figures

REINFORCED JEWELRY CLASP

BACKGROUND OF THE INVENTION

1. Field of the Invention

The present invention relates to jewelry clasps of the type used in jewelry such as bracelets and necklaces to secure the jewelry to the wearer.

2. Description of Background Information

Virtually all necklaces and bracelets are secured to the wearer by means of a clasp. One of the most popular clasps in use in recent years has been the clasp described in U.S. Pat. No. 4,170,809, the description of which is hereby incorporated by reference thereto. A modified version of the clasp is generally depicted in FIG. 1. The invention relates to improvements generally, and is illustrated by way of example only with reference to the clasp shown in the drawings.

As seen in FIG. 1, clasp 11 comprises male and female members 13 and 15 respectively. Male member 13 is in the form of a tongue having an upstanding wall 17 integral with folded leaf spring 19. Upstanding wall 17 is generally formed from the same blank as the leaf spring. Although elements 17, 18 and 19 are normally formed from a single blank, if desired element 19 can be separately secured to element 18. An upstanding press button 21 is provided on the leaf spring so as to allow for compression thereof as desired.

Male member 13 is inserted within opening 23 of female member 11. The opening is generally configured in a manner such that the leaf spring of the male member fits therein. The opening may be provided with an extended base portion 25 configured to accommodate the base 18 of the leaf spring. Leaf spring 19 itself is accommodated within opening portion 27 while press button 21 slides through slit portion 29. Upon insertion of the leaf spring into opening 23 upstanding portion 19 of the leaf spring is initially compressed slightly and then expands after the rear end of the leaf spring has fitted within opening 23. This expansion of the leaf spring locks the clasp shut. Expansion of the leaf spring results in push button 21 protruding out of slit 29 such that it is accessible to the user. The button protrudes sufficiently such that the exertion of pressure on button 21 sufficiently depresses the upstanding portion 19 of the leaf spring to permit removal of the male member 13 from female member 15. Jewelry such as a bracelet or necklace has each of its ends secured to upstanding member 17 and end wall 31 of female member 15 in a manner not shown.

While such a clasp has proven extremely useful for many years, the increased cost of gold has pressured manufacturers to use less and less gold both in jewelry generally, and clasps in particular. Attempts to reduce the amount of gold used, necessarily result in reduced wall thicknesses. While female member 15 is in a sense naturally reinforced by means of its box-like structure, upstanding wall member 17 of male member 13 is normally not reinforced. Thus, reduced wall thickness results in an inability of the male member to withstand the "pull" exerted by heavier jewelry such as gold necklaces and the like. This pulling ultimately results in a bending and breaking of the wall member, which in turn results in loss of the item.

If an attempt is made to overcome the above disadvantage by using a greater wall thickness, this results in a larger opening being necessary in the female clasp member. Such an opening weakens the female member and is not possible with smaller models.

SUMMARY OF THE INVENTION

According to the invention a jewelry clasp is provided which comprises an angled portion which is subject to stress as a result of the weight of the jewelry to which it is attached. The clasp further comprises one or a plurality of reinforcement ribs positioned and configured to increase the tensile strength of the angled portion. The reinforcement ribs may be formed either by stamping the angled portion (after bending), by means of a reinforcement strut, or a wire inlaid within the angled portion.

According to a preferred embodiment of the invention, the reinforcement rib is tetragonal and protrudes into the angled portion.

In the embodiment shown, the clasp is formed of male and female clasp members, and the angled portion is formed by an upstanding wall member and the base of the male clasp member.

When the rib is stamped into the angled portion, the depth of the reinforcement rib is generally defined by the following empirically derived equation:

$$D=7.5\times PTHW/2^{(N-1)1.7}$$

wherein:

D=rib depth in inches measured from the exterior surface to the bottom of the rib well;

P=desired pull strength at failure in lbs./sq. inch;

T=metal thickness in inches;

H=wall height in inches;

W=tongue width in inches; and

N=number of ribs.

According to yet another aspect of the invention, the improvement of the invention is used together with existing clasp structure so as to provide a further improved result. Thus, the reinforcement ribs are stamped into the angled portion adjacent to attachment means which are normally used to allow for attachment of the jewelry to the clasp. Since the attachment means are normally secured to the clasp by solder, this feature can be utilized to provide yet a further improved result. This is achieved by permitting the solder which is used to at least partially fill the reinforcement rib. In a most preferred embodiment the attachment means is secured and anchored by solder which fills at least one groove formed in the exterior of the angled portion, on the reverse side of the reinforcement rib. The attachment means which may be in the form of at least one eyelet is (are) secured on top of or directly over the groove.

Thus, according to the invention a method of forming a jewelry clasp comprising male and female members is provided which comprises the step of securing the attachment means to the clasp by soldering whereby solder flows into the at least one reinforcement rib to strengthen the rib, and more rigidly anchor the attachment means to the clasp.

DESCRIPTION OF PREFERRED EMBODIMENTS

As was noted above, the invention relates to clasps generally, and in one particular embodiment to clasps of the type illustrated in the Figures. However, it is to be understood that the invention is not limited specifically to the clasps illustrated and extends to all clasps and the like which are small and made of expensive materials wherein a reduction in wall thickness results in a weakened construction.

Figure 2:
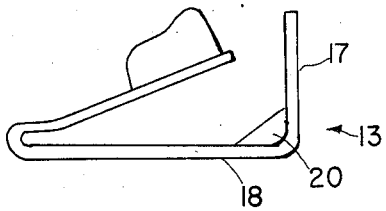
FIG. 2 illustrates a side view of the clasp male member according to the invention.
Figure 4:
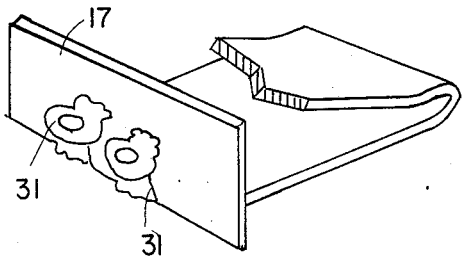
FIG. 4 illustrates a rear perspective side view of the male clasp member according to the invention.
Figure 3:
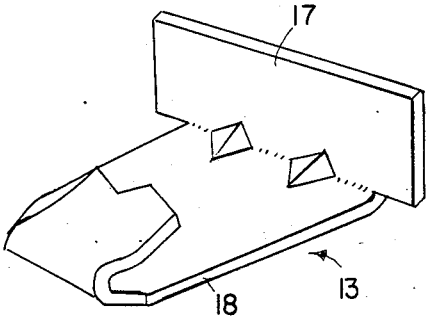
FIG. 3 illustrates a side perspective view of the clasp male member according to the invention.

Referring to FIGS. 2–4, male member 13 is shown generally as comprising upstanding wall member 17 and base member 18.

According to the invention, upstanding wall member 17 is reinforced against bending and other deformation by the use of at least one reinforcement rib 20. As shown, the rib has a generally tetragonal hollowed configuration. Such a configuration provides maximum reinforcement and support.

The ribs themselves may be formed in a variety of manners, however the most preferred technique is to form the ribs during the forming process of male member 13 itself. Using this technique, the stamping process forms a flat blank into the male member having upstanding wall member 17. The stamping member (forming die) may itself be provided with ribs which in turn punch ribs 20 into male member 13 at the general location shown in the Figures. The ribs are most preferably formed in the angled portion after the portion has been formed. If the rib is made prior to bending the blank to form the angled portion between the upstanding wall member and the base, the subsequent bending process will result in a weakening of the rib.

As noted above, the general configuration of the rib itself is generally tetragonal, although other rib configurations are possible. Depending upon the size of the clasp, the depth of the rib may vary, however, such ribs are generally on the order of 0.015 inches deep. The relationship defining the depth of the rib may be described as follows:

$$D=7.5\times PTHW/2^{(N-1)1.7}$$

wherein:

D=rib depth in inches measured from the exterior surface to the bottom of the rib well;

P=desired pull strength at failure in lbs./sq. inch;

T=metal thickness in inches;

H=wall height in inches;

W=tongue width in inches; and

N=number of ribs

Quite obviously, the above equation must be utilized with due regard for available metal thickness. By way of example, it is found that to achieve a pull strength of 704 lbs./sq. inch of upstanding wall member, using 0.012 inch thickness metal, $\frac{1}{8}$ inch wall height, $\frac{1}{4}$ inch tongue width, and 2 ribs, that a 0.015 inch rib depth is required.

The number of ribs which are used is likewise generally a function of the size of the clasp which is, of course, related to the anticipated pull strength that the necklace or bracelet must withstand. Generally speaking, the number of ribs utilized is anywhere from 1–3, the width of the upstanding wall is 1/16–$\frac{3}{4}$ inches, and the wall height is 1/16–5/16 inches. For widths up to 3/16 inch, one rib is used, from 3/16 to 5/16 inch, two ribs are used, and from 5/16 to $\frac{3}{4}$ inch 3 ribs are used. Of course, larger widths may be contemplated with more ribs, however such large sizes are rare.

Throughout the application reference is made to ribs which when viewed in cross-section, form isosceles triangles, i.e., wherein the rib is formed at an angle of approximately 45 degrees to both the upstanding wall member and the base of the tongue.

Figure 5A:
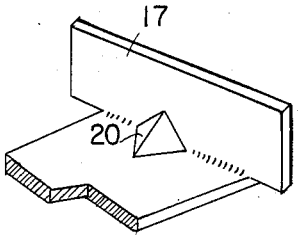
FIGS. 5A–5C illustrate rear perspective views of the male member having 1, 2 and 3 reinforcements, respectively.
Figure 5B:
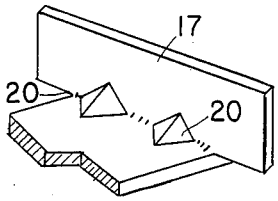
Figure 5C:
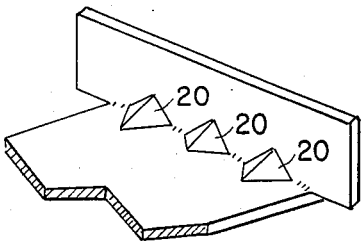

Embodiments having 1, 2 and 3 ribs respectively are shown in FIGS. 5A–5C.

When using a plurality of ribs the spacing is preferably selected such that with one rib, the rib is positioned at the center of the wall; when two ribs are present they are each spaced from the edge by a distance x, and are spaced from one another by 2x; when three ribs are present, each of the outer ribs is spaced from the outer edge by a distance of approximately $\frac{1}{8}$ inch, and the inner rib is midway between the outer ribs.

Most preferably, the ribbed structure of the invention is utilized in connection with clasps made of 10, 14, and 18 karat gold which require reinforcement as the wall thicknesses of the clasps is reduced in an attempt to reduce their price. The inventive technique finds particular value in connection with silver because silver is inherently weaker than gold, and, therefore, requires more reinforcement. Quite obviously, the technique may be used as well with other metals.

While reinforcement of the wall might generally be expected to provide improved wall strength, what has surprisingly been found according to the invention is that it is possible to provide improved strength without the use of additional material, as might normally have been expected.

EXAMPLE

A tongued member generally configured as shown in FIGS. 2–4 is constructed by stamping with 2 ribs, each 0.015 inches deep. The ribs are spaced from each other by a distance equal to twice the distance of the rib from the edge of the tongue. The upstanding wall is $\frac{1}{8}$ inch high and $\frac{1}{4}$ inch wide. The wall base is $\frac{1}{4}$ inch wide.

When the fail strength of upstanding wall member 17 is measured using a metal thickness of 0.012 inches of 14 karat gold, the upstanding wall member bends at a pull of 13 pounds. However, using the ribs of the invention, it is unexpectedly found that bending does not occur until 22 pounds tension. This surprising increase in tensile strength is achieved with no additional cost due to added material as might otherwise have been expected.

The advantages of the invention are obvious. Thus, it is now possible to achieve satisfactory tensile strength using much thinner wall thicknesses than was previously thought possible.

Yet another advantage which flows from the invention relates to the additional reinforcement which is achieved because of the way that clasps of the invention are normally made. In such clasps the piece of jewelry is normally directly secured to the clasp by soldering the ends of the jewelry onto each of the male and female clasp members, or by securing the jewelry ends to eyelets which are themselves soldered onto the clasp members. When the jewelry ends or eyelets, and the reinforcement ribs are appropriately relatively positioned, solder which is used to attach the eyelets flows into the depressions formed in the members. The reinforcement ribs are thus themselves reinforced by the solder which settles and hardens in the grooves formed on the outside of the member, behind the ribs. This is an important feature because the heat associated with soldering would normally act to weaken the metal of the upstanding wall member. By filling the groove with solder additional strength is provided.

Another advantage which follows from the use of the reinforcement ribs in such an embodiment is the anchoring effect which results from the solder flowing into the reinforcement ribs. Thus, the eyelets or ends are better secured to the clasp itself because of the anchoring provided by the reinforcement ribs.

In order to achieve maximum benefit from the ribs as an anchor, the eyelet or end is preferably secured to the upstanding wall over the groove itself which is directly behind the rib. Furthermore, it is preferable to completely fill the rib(s) with the solder in a manner such that the groove is completely filled and becomes invisible. This feature provides improved appearance, and the solder fill adds substantial strength to the rib(s). Such an embodiment is illustrated in FIG. 4 wherein attachment means in the form of eyelets 31 are provided on upstanding wall member 17. Solder used to secure the eyelets is flowed down into the recess formed by the reinforcement rib to achieve the anchoring and strengthening effects referred to above.

Throughout the application reference is made to ribs which when viewed in cross-section, form isosceles triangles, i.e., wherein the rib is formed at an angle of approximately 45 degrees to both the upstanding wall member and the base of the tongue. However, when using very high upstanding members, it is clearly within the scope of the invention to utilize ribs which are not at 45 degree angles to the walls of the angled portion. This may be a particular consideration where because of the configuration of the article, the ribs may interfere with closure of the clasp, if they are not appropriately positioned.

Figure 6:
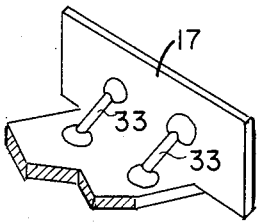
FIG. 6 illustrates a system having a strut reinforcement.

FIG. 6 illustrates an alternative embodiment of the invention in which instead of punching a reinforcement rib in the manner illustrated in the previous embodiments, a wire strut reinforcement is utilized. As may be seen from the Figure, a reinforcement strut 33 is used to reinforce upstanding wall member 17.

Figure 7:
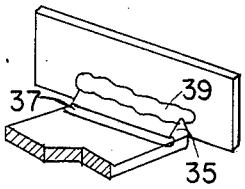
FIG. 7 illustrates a system having an inlaid wire reinforcement.

FIG. 7 illustrates yet another embodiment in which a reinforcement is provided by the use of a wire, in this instance, by a wire which is inlaid into the angled portion to be reinforced. As may be seen from the Figure, a wire 35 is inlaid in the angled portion by soldering along 37 and 39 such that the angled portion is reinforced.

The wire used in each of the embodiments of FIGS. 6 and 7 may be of any appropriate configuration or material, e.g., circular, triangular etc., and may even be hollow if desired. In certain circumstances, such as when the ribs may interfere with closure of the clasp, a triangular wire of the type shown may be preferable since this configuration will minimize hindrance to a maximum extent.

Although the invention has been described with reference to one particular type of clasp member, it is obvious that the invention is not limited to the particular clasp member shown in the Figures and that the use of ribs to improve strength of jewelry clasps may be employed in any one of a variety of clasps of which only one has been illustrated. In each case, however, it is a characteristic of the invention that improved tensile strength is achieved without the use of added material, thus eliminating the added expense associated therewith.

What is claimed is:

1. A jewelry clasp comprising a male clasp member and a female clasp member which together form a separable clasp, one of said members comprising an upstanding wall and a base which form an angled portion, said angled portion being subject to stress as a result of the weight of the jewelry to which said jewelry clasp is attached, wherein said clasp further comprises at least one reinforcement rib stamped in said angled portion, thereby increasing the tensile strength of said angled portion, and wherein said upstanding wall is soldered to the jewelry, or to attachment means for attaching the jewelry to said clasp, at a position closely adjacent to said reinforcement rib, said solder at least partially filling the corresponding groove formed on the outside of said angled portion by said at least one reinforcement rib.

2. The jewelry clasp as defined by claim 1 wherein said at least one reinforcement rib is tetragonal.

3. The jewelry clasp as defined by claim 1 comprising a plurality of said ribs.

4. The jewelry clasp as defined by claim 1 wherein said male clasp member comprises said upstanding wall and base.

5. The jewelry clasp as defined by claim 1 wherein said at least one reinforcement rib is tetragonal and protrudes into the angled portion.

6. The jewelry clasp as defined by claim 1 wherein the depth of said at least one reinforcement rib is generally defined by the following equation:

$$D=7.5\times PTHW/2^{(N-1)1.7}$$

wherein:

D=rib depth in inches measured from the exterior surface of the bottom of the rib well;

P=desired pull strength at failure in lbs/sq. inch;

T=metal thickness in inches;

H=wall height in inches;

W=tongue width in inches; and

N=number of ribs.

7. The jewelry clasp as defined by claim 1 wherein the jewelry is secured directly by its ends to said clasp by said solder.

8. The jewelry clasp as defined by claim 7 wherein said solder completely fills said groove.

9. The jewelry clasp as defined by claim 1 further comprising attachment means adjacent to said at least one reinforcement rib for attaching jewelry to said clasp.

10. The jewelry clasp as defined by claim 9 wherein said attachment means comprises an eyelet secured to said clasp by solder.

11. The jewelry clasp as defined by claim 10 wherein said solder completely fills said groove.

12. A method of forming a jewelry clasp comprising male and female clasp members which together form a separable clasp, each of said male and female clasp members having attachment means thereon for attachment of jewelry thereto, at least one of said male and female clasp members comprising an upstanding wall and a base which form an angled portion therein with at least one reinforcement rib provided therein and a corresponding groove formed on the outside of said angled portion, said method comprising the step of securing said attachment means to said clasp by soldering said attachment means to said upstanding wall at a point closely adjacent to said at least one reinforcement rib, whereby solder flows into said groove, and more rigidly anchors said attachment means to said clasp.

13. The method as defined by claim 12 wherein said solder fills said groove.

14. The method as defined by claim 12 wherein the depth of said at least one reinforcement rib is generally defined by the following equation:

$$D=7.5\times PTHW/2^{(N-1)1.7}$$

wherein:

D=rib depth in inches measured from the exterior surface to the bottom of the rib well;

P=desired pull strength at failure in lbs/sq. inch;

T=metal thickness in inches;

H=wall height in inches;

W=tongue width in inches; and

N=number of ribs.

* * * * *

UNITED STATES PATENT AND TRADEMARK OFFICE

CERTIFICATE OF CORRECTION

PATENT NO. : 4,697,315

DATED : October 6, 1987

INVENTOR(S) : Simon GELDWERTH

Figure 1:
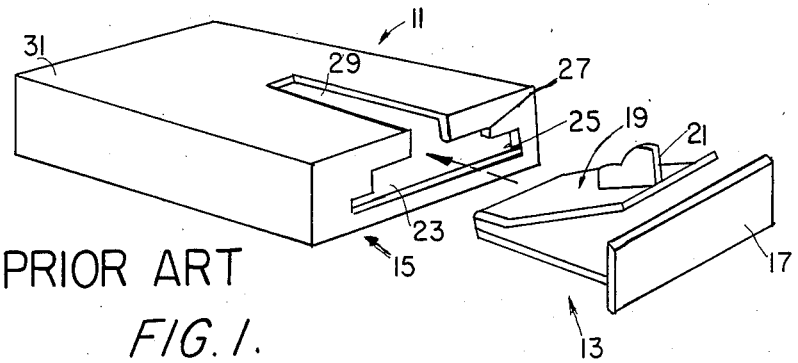
PRIOR ART FIG. 1.
FIG. 1 illustrates one type of clasp which may be reinforced by using the system of the invention.

It is certified that error appears in the above-identified patent and that said Letters Patent is hereby corrected as shown below:

At column 1, line 20, insert ---and FIG. 2--- after "FIG. 1".

At column 1, line 55, delete "," between "used" and "necessarily".

At column 2, line 5, insert ---,--- between "invention" and "a".

At column 2, line 33, change "inche" to ---inches---.

At column 6, line 61, insert ---said--- between "by" and "solder".

In the Abstract, change "attachement" to ---attachment---.

In the Abstract, delete "the" between "strengthening" and "at".

At column 4, line 9, change "3" to ---three---.

At column 4, line 12, insert ---,--- between "application" and "reference".

Signed and Sealed this

Fourteenth Day of February, 1989

*Attest:*

DONALD J. QUIGG

*Attesting Officer*

*Commissioner of Patents and Trademarks*